United States Patent [19]

Hehn

[11] Patent Number: 4,837,593

[45] Date of Patent: Jun. 6, 1989

[54] APPARATUS FOR WET TREATMENT OF PHOTOSENSITIVE MATERIAL

[75] Inventor: Wilfried Hehn, Munich, Fed. Rep. of Germany

[73] Assignee: Agfa-Gevaert Aktiengesellschaft, Leverkusen, Fed. Rep. of Germany

[21] Appl. No.: 40,852

[22] Filed: Apr. 21, 1987

[30] Foreign Application Priority Data

Apr. 26, 1986 [DE] Fed. Rep. of Germany ..... 3614253

[51] Int. Cl.[4] ..... G03D 3/02; G03D 3/13

[52] U.S. Cl. ..... 354/322; 354/325

[58] Field of Search ..... 354/316, 320, 321, 322, 354/324, 325

[56] References Cited

U.S. PATENT DOCUMENTS 3,477,357 11/1969 Snarr ..... 354/322
3,589,261 6/1971 Krikelis ..... 354/322
4,534,635 8/1985 Johnston et al. ..... 354/322
4,708,453 11/1987 Fryda et al. ..... 354/320

FOREIGN PATENT DOCUMENTS 3242810 5/1984 Fed. Rep. of Germany ..... 354/324

*Primary Examiner*—A. A. Mathews
*Attorney, Agent, or Firm*—Peter K. Kontler

[57] ABSTRACT

Sheets or webs of color photographic material are conveyed at a relatively low speed through a developing bath in a first vessel and thereupon through a fixing bath in a second vessel. Some liquid is drawn from the second vessel or from a source of fresh fixing solution and is sprayed uniformly and at an elevated pressure against the photosensitive layer of photographic material at or close to the upper level of liquid in the second vessel so as to remove streaks or droplets of developing solution which adhere to the photosensitive layer downstream of the first vessel.

12 Claims, 2 Drawing Sheets

APPARATUS FOR WET TREATMENT OF PHOTOSENSITIVE MATERIAL

BACKGROUND OF THE INVENTION

The present invention relates to improvements in methods of and in apparatus for wet treatment of photosensitive materials, especially color photographic papers. More particularly, the invention relates to improvements in methods of and in apparatus for treating exposed photographic materials. Still more particularly, the invention relates to improvements in methods of and in apparatus for developing, fixing and/or similarly treating exposed photographic films, X-ray films, photographic papers and similar photographic materials, e.g., on their way to a trimming, inspecting, stacking, classifying or other station.

Exposed photographic sheet or web material is normally conveyed through a first vessel wherein it is acted upon by a suitable developing solution, thereupon through a second vessel which contains a suitable fixing bath and, if necessary, through one or more additional vessels containing a rinsing bath, a bleaching bath and/or other liquid media. As a rule, the material is conveyed at a relatively low speed by pairs or other arrays of rollers at least one of which is driven and which serve to advance the material along a predetermined path having successive portions in successive vessels so as to ensure the establishment of predictable contact between the material on the one hand and various liquids on the other hand. When an apparatus is designed for wet treatment of a series of sheets of photosensitive material (such as color photographic paper one side of which has a photosensitive coat or layer), the rollers of the conveying means are preferably submerged in the respective baths so as to educe the cost of cleaning to a minimum. Rollers which extend in part above and in part below the liquid level in a vessel of a developing machine create numerous problems, especially in the region where a sheet leaves the vessel which contains a developing solution to enter a body of fixing solution in the next-following vessel. In many instances, the last rollers in the first tank must advance the sheets vertically or nearly vertically downwardly toward the nip of the first rollers in the second tank. This often entails the accumulation of droplets and/or rivulets or streaks of developing solution on the downwardly advancing sheets. The distribution of such droplets or streaks is not uniform across the width of the sheet which is in the process of entering the fixing bath. This, in turn, results in non-uniform development of the sheets (actually in uncontrollable secondary development of certain portions of the sheets). Moreover, the droplets and streaks prevent predictable bleaching or fixing of the sheets, primarily because the fixing of those portions which carry streaks or droplets of developing solution into the second vessel is delayed as a result of secondary development and also due to the fact that a predetermined interval of time elapses before the droplets and rivulets or streaks of developing solution are admixed to the body of fixing medium in the second bath. In other words, the body of fixing medium in the second bath cannot act upon the photosensitive layer of a sheet in the second vessel with the required degree of predictability and uniformity. The just described conditions are particularly likely to develop when the sheets are transported at a relatively low speed in the range of 5–40 cm/min.

Attempts to solve the just discussed problems involve the utilization of a separate bath (so-called stop bath) which is disposed between the first vessel (developing bath) and the second vessel (fixing bath). The stop bath is capable of collecting at least some droplets and/or rivulets of developing solution ahead of the vessel for the fixing bath; however, the provision of such additional bath contributes to the overall cost and bulk of the developing machine and prolongs the interval of time which is required to complete the development of emulsions on successive sheets or webs.

In accordance with another earlier proposal, the developing machine employs a set of squeezing rollers or squeegees serving to remove the droplets and/or streaks from the sheets which have left the first vessel (containing the developing solution) and are about to enter the second vessel which contains the fixing bath. The squeezing rollers must be uniformly rinsed with fresh water whenever and as long as the developing machine is in use because remnants of developing solution which would be permitted to accumulate on the squeezing rollers would be likely to oxidize and to adversely influence the quality of the next-following sheets. Furthermore, the provision of additional (squeezing) rollers between the first and second vessels and of the means for continuously rinsing the additional rollers with water or the like contributes excessively to the initial and maintenance cost as well as to the bulk of the developing machine.

OBJECTS AND SUMMARY OF THE INVENTION

An object of the invention is to provide a novel and improved method of preventing streaks, droplets and similar undesirable accumulations of a first liquid medium from adversely influencing the treatment of photosensitive material by means of a second liquid medium, especially of preventing droplets, rivulets or like accumulations of developing solution from interfering with proper treatment of sheets or webs of photosensitive material in a fixing bath.

Another object of the invention is to provide a method which renders it possible to prevent remnants of a first liquid from interfering with the treatment of photosensitive material by a second liquid without the need for a stop bath and/or squeezing rollers.

A further object of the invention is to provide a method which can be practiced with apparatus that need not appreciably depart from heretofore known apparatus for wet treatment of photosensitive materials in the form of sheets, webs, strips and the like.

An additional object of the invention is to provide a novel and improved apparatus for the practice of the above outlined method.

A further object of the invention is to provide a simple, compact and relatively inexpensive apparatus which reliably prevents streaks, droplets and similar accumulations of developing solution from interfering with proper treatment of successive sheets, webs or strips of photosensitive material in a fixing bath.

Still another object of the invention is to provide the apparatus with novel and improved means for removing irregular accumulations of a first liquid from successive sheets of photosensitive material not later than in the bath which is confined in a next-following vessel.

Another object of the invention is to provide a developing machine which embodies the above outlined apparatus.

An additional object of the invention is to provide a novel and improved vessel for a fixing bath which can be used in the above outlined apparatus.

A further object of the invention is to provide novel and improved means for contacting the liquid medium of a fixing bath against successive increments of running webs, sheets or strips in a developing machine.

An additional object of the invention is to provide a novel and improved group of vessels which can be used in the above outlined apparatus.

One feature of the invention resides in the provision of a method of wet treating photosensitive material, particularly running webs, strips or sheets of color photographic material. The method comprises the steps of conveying the material in a predetermined direction along a predetermined path, establishing and maintaining a first body of liquid in a first portion of the path, establishing and maintaining a second body of liquid in a second portion of the path downstream of the first portion, and directing against the material downstream of the first portion and not later than in the second portion of the path a liquid medium whose composition matches or approximates the composition of the second body.

As a rule, one side of the material which is being treated is coated with a photosensitive substance, and the directing step preferably includes spraying the liquid medium against the photosensitive substance.

The first body of liquid can constitute a developing bath, and the second body of liquid can constitute a fixing bath.

The second body of liquid extends in the second portion of the path to a predetermined upper level, and the directing step can include directing the liquid medium against successive increments of photographic material in the region of (at, above or below) such level.

In accordance with a presently preferred embodiment of the method, the directing step includes spraying the liquid medium against the photosensitive material along at least one line extending transversely of the predetermined direction.

The method preferably further comprises the step of pressurizing the fluid medium prior to the directing step, and the directing step can include uniformly spraying the liquid medium transversely of the predetermined direction.

The conveying step preferably includes advancing the photosensitive material at a relatively low speed, such as at a speed of 5–40 cm/min.

The material is preferably conveyed in such a way that it has an upper side and an underside in or immediately ahead of the second portion of the predetermined path. The directing step includes spraying the liquid medium against one of such sides.

In accordance with a presently preferred embodiment of the method, the directing step includes spraying against the photosensitive material a plurality of jets of liquid medium, and the method preferably further comprises the step of collecting the sprayed liquid medium in the second body of liquid.

Another feature of the invention resides in the provision of an apparatus for wet treatment of photosensitive material, particularly running webs, strips or sheets of color photographic paper or a like material. The apparatus comprises a first vessel for a first body of liquid, a second vessel for a second body of liquid, means for conveying the photosensitive material in a predetermined direction along a predetermined path having a first portion in the first vessel and a second portion in the second vessel, a source of liquid medium the composition of which matches or approximates that of the second body of liquid, and means for directing the liquid medium against the photosensitive material downstream of the first portion and not later than in the second portion of the predetermined path.

The apparatus can be utilized for wet treatment of material one side of which is coated with a photosensitive substance. The second body of liquid fills the second vessel to a predetermined level, and the conveying means can comprise at least one pair of rollers at least one of which is disposed in the second vessel at least in part below the predetermined level. The directing means of such apparatus can comprise a conduit which is disposed above the one roller and has at least one orifice which serves to spray the liquid medium against the photosensitive substance at the one side of the photosensitive material. Such side can constitute the upper side or the underside of the photosensitive material. The just described apparatus can comprise conveying means which includes the aforementioned pair of rollers, and the second vessel of which has a sidewall nearer to the other roller of the pair. The photosensitive layer can face away from the wall in the region where the liquid medium contacts the photosensitive layer. The source in such apparatus can comprise a tank for liquid medium and means for pumping the liquid medium from the tank into the conduit.

As already mentioned, the rollers of the conveying means can include at least one roller disposed in the second vessel at least in part below the predetermined level. The source of liquid medium then include a tank which is provided in the second vessel and has a closed top. The directing means of such apparatus can comprise a plurality of orifices which are provided in the upper portion of the tank and serve to direct sprays of liquid medium against the photosensitive material in the region of the one roller. As mentioned above, one side of the photosensitive material is coated with a photosensitive layer, and the conveying means of the apparatus for treatment of such material can comprise means for advancing the material past the directing means in such a way that the photosensitive layer is disposed at the underside of the material.

The source can comprise at least one pipe having a predetermined cross section, and the directing means can include a plurality of orifices the combined area of which at most equals the cross-sectional area of the pipe.

The orifices of the directing means can form at least one row extending transversely of the predetermined direction and serving to discharge neighboring streams or jets of liquid medium in such a way that the neighboring streams contact or partially overlap each other.

In accordance with a presently preferred embodiment of the apparatus, the conveying means comprises a plurality of parallel rollers in the second vessel, and the source can include a tank which is provided in the second vessel and has an upper portion and an enlarged lower portion. The directing means includes a plurality of orifices which are provided in the upper portion and serve to spray the liquid medium against the photosensitive material. The source of such apparatus can further comprise a pipe which serves to deliver liquid medium into the lower portion of the tank and extends in substantial parallelism with the rollers. The tank can comprise a flow restrictor which is disposed between the level of the outlet of the pipe and the upper portion of the tank.

The arrangement is or can be such that the source of liquid medium includes means for feeding the liquid of the second body to the directing means. In such apparatus, the source can comprise a tank in the second vessel, and the feeding means can include pump means for inducing the flow of liquid from the body in the second vessel into the tank.

The apparatus preferably further comprises means for maintaining the upper level of liquid in the second vessel at least substantially constant. Such maintaining means can comprise one or more overflow pipes.

The vessels can be substantially identical, and the conveying means can comprise substantially identical first and second units which serve to respectively advance the photosensitive material through the first and second vessels.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
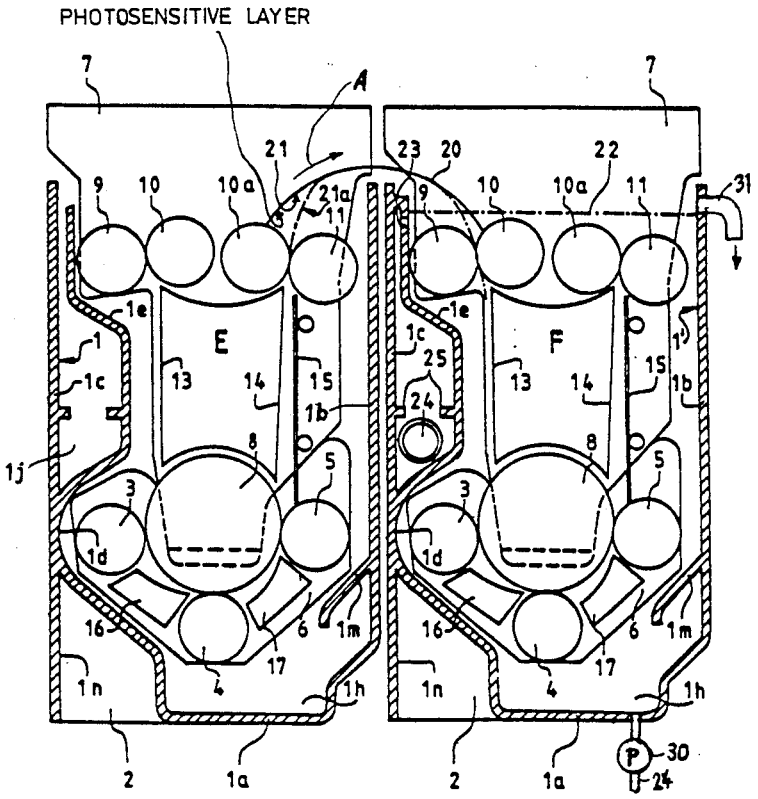
FIG. 1 is a fragmentary vertical sectional view of an apparatus which embodies one form of the invention.

Referring first to FIG. 1, there is shown an apparatus which forms part of or constitutes a developing machine for photosensitive material 21 in the form of sheets, strips or webs. One side of the material 21 is coated with a photosensitive layer 21*a*. The material is assumed to have been exposed to radiation and to require development, fixing and, if necessary, additional treatment on its way to a cutting, trimming or packaging station. For example, the illustrated photosensitive material 21 can constitute a sheet of color photographic paper.

The apparatus of FIG. 1 comprises two vessels 1 and 1' each of which is similar to the vessel shown in FIGS. 3 and 4 of the commonly owned copending U.S. patent application Ser. No. 913,950 filed Oct. 1, 1986 for "Arrangement for wet processing photosensitive articles", now U.S. Pat. No. 4,708,453. For convenience, the disclosure of the copending application is incorporated herein by reference. The first vessel 1 comprises two end walls 2 (only one shown) and an extruded portion which is disposed between the two end walls and is bonded thereto. The extruded portion includes two sidewalls 1*b* and 1*c* as well as a bottom wall 1*a*. The vessel 1 rests on the floor or on another support by contacting such support with the lower end faces of its end walls 2. The width of the walls 1*a*, 1*b*, 1*c* equals or slightly exceeds the width of photosensitive material 21 which is to be treated in the improved apparatus. The lower portion of the sidewall 1*c* has a first bulge 1*d* and the upper portion of this sidewall has a second bulge 1*e*. That part of the sidewall 1*c* which defines the bulge 1*e* constitutes the inner wall of a jacket 1*j* which can receive a supply of circulating coolant (for example, water) for the body of developing liquid in the vessel 1.

The sidewall 1*b* has an inwardly extending rib 1*m* which is disposed opposite the bulge 1*d* of the sidewall 1*c*. The end walls 2 can be made integral with the respective ends of the walls 1*a*, 1*b*, 1*c* and their mutual spacing can slightly exceed th-e width of the material 21. Alternatively, the end walls 2 can constitute separately produced components which are welded, glued or otherwise sealingly secured to the respective end portions of the walls 1*a*–1*c* in a manner as disclosed in the aforementioned commonly owned copending patent application. The thickness and the dimensions of the end walls 2 will determine the stability of the vessel 1. In many instances, the end walls 2 preferably extend laterally beyond the bottom wall 1*a* and are bonded to or are made integral with the downwardly extending leg 1*n* of the sidewall 1*c*. One presently preferred mode of making the end walls 2 is shown in FIG. 1 of the aforementioned copending patent application. Thus, each end wall 2 can be formed with projections having an outline which is complementary to the outlines of the adjacent end portions of the walls 1*a*–1*c*, and such projections are either inserted into or surround the adjacent end portions of the walls 1*a*–1*c* when the vessel 1 is assembled. The projections are thereupon welded, adhesively connected or otherwise sealingly secured to the respective end portions of the walls 1*a*–1*c*.

The end walls 2 can be formed with bearing elements (not specifically shown) for the shafts or end portions of several rollers which form part of a means for conveying a series of successive sheets, webs or strips 21 of photosensitive material along a predetermined path a first portion of which extends into the first vessel 1 and a second portion of which extends into the second vessel 1' which is adjacent the vessel 1 and the construction of which is or can be similar to that of the vessel 1. The only important difference between the illustrated vessels 1 and 1' is that the portion 1*e* of the sidewall 1*c* of the second vessel 1' defines or constitutes a tank the interior of which is at least substantially sealed from the interior of the major portion of the vessel 1' and which can receive a supply of pressurized liquid medium, preferably a medium the composition of which matches or approximates that of the body of liquid (such as a fixing bath) in the major part of the second vessel 1'. The aforementioned bearing elements on the end walls 2 of the vessels 1 and 1' are preferably open from above so that the end portions or the shafts of the rollers which form part of the conveying means can be readily inserted into the respective bearing elements from above.

The rollers of the conveying means include three idler rollers 3, 4, 5 which are mounted in open bearing elements of the end walls 2 of the respective vessels 1, 1' and can be driven by conveyed photosensitive material when such material is advanced by a driven roller 8 which can be mounted on the lower section 6 of a two-piece rack constituting a support for certain components of the conveying means. Reference may be had to FIG. 4 of the aforementioned copending patent application. As shown in FIG. 1, each of the vessels 1 and 1' can accommodate a discrete two-piece rack each including a lower section 6 which carries the rollers 3, 4, 5 and an upper section 7 which carries the driven roller 8 as well as a set of upper rollers 9, 10, 10*a* and 11. The rollers 9 and 10 define a first nip by way of which a sheet 21 of photosensitive material enters the developing solution in the vessel 1, and such sheet thereupon advances downwardly toward the nip of the rollers 3 and 8. The material 21 thereafter advances toward and through the nips of the rollers 8, 4 and 8, 5 on its way toward the nip of the rollers 10*a*, 11 and out of the vessel 1 on its way into the vessel 1' wherein it enters the nip of the first pair of rollers 9, 10. The rollers 9 are accommodated in the bulges which are defined by the portions 1*e* of the sidewalls 1*c*, and the rollers 3 extend into the bulges 1*d* of the respective vessels 1 and 1'. The lower sections 6 of the two-piece racks for the rollers of the conveying means can rest in part on the upper sides of the bulges 1*d* and in part on the legs or ribs 1*m* of the respective sidewalls 1*b* and extend into the lowermost portions 1*h* of the respective vessels. The lower sections 6 of the racks are preferably pivotable on their way toward and away from the operative positions which are shown in FIG. 1. This renders it possible to advance the rack sections 6 downwardly beyond the portions 1*d* of the respective sidewalls 1*c*. It will be noted that the portions 1*e* extend well into the interior of the respective vessels 1 and 1'. An advantage of pivoting the rack sections 6 during insertion into the respective vessels is that such pivoting promotes the expulsion of air bubbles which might have been entrapped in the region of the rollers 3, 4, 5 and/or portions of the rack sections 6. The expulsion of air bubbles contributes to more uniform treatment of photosensitive material by the developing solution in the vessel 1 and by the fixing bath in the vessel 1'.

The rollers 9, 10, 10*a* and 11 (which can be driven) are rotatably mounted on the upper sections 7 of the respective racks. Such upper sections are inserted in such a way that the driven rollers 8 cooperate with the previously inserted rollers 3, 4, 5 on the corresponding lower rack sections 6 when the apparatus including the vessels 1 and 1' is in actual use. The upper sections 7 are provided with pairs of guide means 13, 14 which ensure that the leaders of successive sheets 21 find their way from the nip of the respective rollers 9, 10 toward the nip of the respective rollers 3, 8. The lower sections 6 carry additional guide means 16 and 17 which respectively steer the leaders of sheets 21 from the rollers 3 toward the rollers 4 and from the rollers 4 toward the rollers 5. An additional plate-like guide member 15 can be provided on each upper section 7 opposite the guide means 14 to ensure that successive strips, webs or sheets 21 of photosensitive material advance from the nip of the rollers 8, 5 toward the nip of the rollers 10*a*, 11. The guide means 13, 14, 15, 16, 17 can be made integral with the respective sections of the racks in the vessels 1 and 1'.

Figure 2:
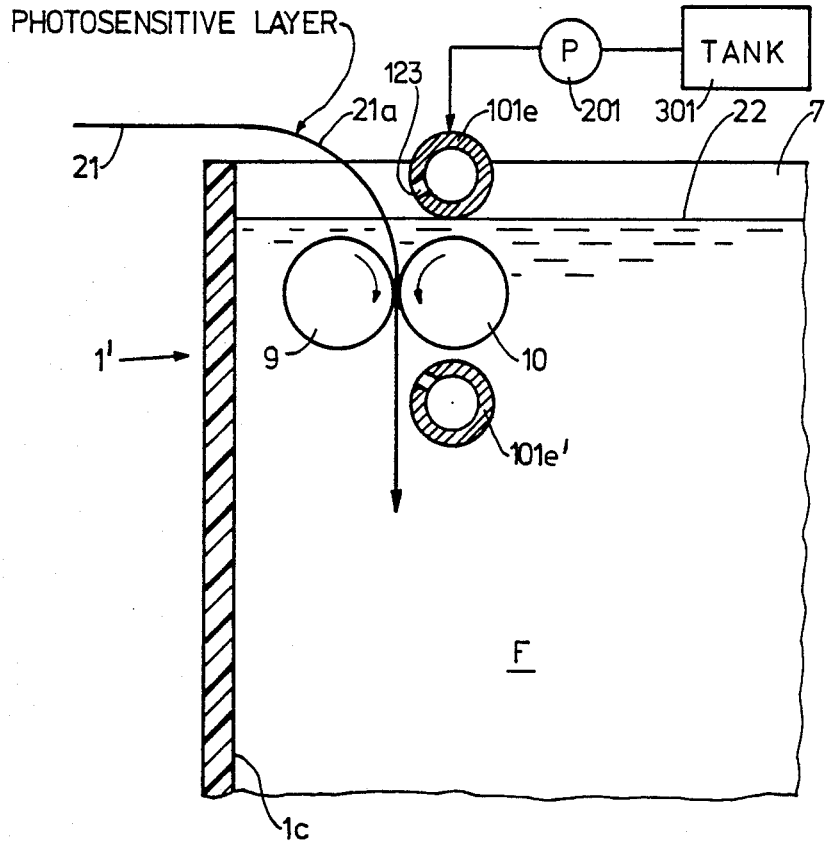
FIG. 2 is a fragmentary vertical sectional view of a modified apparatus.

The vessels 1 and 1' can be coupled to each other, for example, in a manner as shown in FIG. 2 of the aforementioned copending patent application, and can be inserted into a larger container so as to ensure that any solution which has escaped from the vessel 1 and/or 1' is collected in the container. Some splashing of developing solution and/or fixing bath can take place during insertion of rack sections 6 and/or 7 into the respective vessels. The inner side of each portion 1*e* can constitute a guide means which cooperates with the corresponding guide means 13 in order to direct the leaders of successive sheets, strips or webs 21 of photosensitive material from the nip of the rollers 9, 10 toward the nip of the rollers 3, 8 therebelow.

The body or bath of developing solution in the vessel 1 is denoted by the character E, and the fixing bath in the vessel 1' is denoted by the reference character F. The bath F normally fills the vessel 1' to the level 22. This is ensured by the provision of one or more overflow pipes 31 which cause the surplus of fixing medium to enter the aforementioned container in which the vessels 1 and 1' are disposed.

The upper sections 7 of the racks in the vessels 1 and 1' are preferably provided with concave guide surfaces 20 which are adjacent to each other and ensure predictable transfer of successive sheets 21 of photosensitive material from the nip of the rollers 10*a*, 11 in the vessel 1 toward and into the nip of the rollers 9, 10 in the vessel 1'. As shown, the rollers 9, 10, 10*a*, 11 of that unit of the conveying means which is disposed in the vessel 1' are located below the upper level 22 of the fixing bath F. The guide means 20 can constitute portions of hollow cylinders which ensure predictable transfer of successive sheets 21 of photosensitive material from the developing solution E into the fixing bath F. The photosensitive layer 21*a* of the material 21 which is in the process of being transferred into the vessel 1' faces downwardly, namely toward the roller 9 in the vessel 1'. In other words, the photosensitive layer 21*a* of a sheet, web or strip 21 of material which has entered the nip of the rollers 9, 10 in the vessel 1' faces toward the portion 1*e* of the respective sidewall 1*c*.

The portion 1*e* of the sidewall 1*c* of the vessel 1' constitutes a relatively small tank or receptacle which has a narrower upper portion provided with a horizontal row of orifices 23 constituting a means for directing or spraying jets or streams of liquid medium against the photosensitive layer 21*a* of the material 21 which advances toward and enters the nip of the rollers 9, 10 below the upper level 22 of the bath F. The lower portion of the tank which is defined by the portion 1*e* of the sidewall 1*c* in the vessel 1' is enlarged and comprises a flow restrictor 25 above the outlet of a horizontal pipe 24 serving to deliver pressurized liquid medium into the tank. Such pressurized medium fills the tank and issues by way of the orifices 23. The combined cross-sectional area of the orifices 23 at most equals the cross-sectional area of the outlet of the pipe 24 which is or can be at least substantially parallel with the preferably horizontal rollers 9, 10, 10*a*, 11, 3, 4, 5 and 8 in the fixing bath F.

In the embodiment which is shown in FIG. 1, the row of orifices 23 is disposed immediately below the upper level 22 of the fixing bath F. The distribution and dimensions of the orifices 23 are preferably selected in such a wa that they discharge jets of pressurized liquid medium which together form a substantially or practically uninterrupted curtain extending all the way or nearly all the way between the end walls 2 of the vessel 1'. The neighboring jets or streams contact or even partially overlap each other so as to ensure predictable treatment of the entire photosensitive layer 21*a* at the underside or inner side of the material 21 which advances toward and through the nip of the rollers 9 and 10 in the vessel 1'. The source of liquid medium which is sprayed by the orifices 23 further includes a pump 30 which draws liquid medium from the lower portion of the vessel 1' and delivers such medium into the pipe 24. If desired, the pump 30 can supply only a portion of the liquid medium which fills the tank 1*e* in the vessel 1' and the remainder of liquid medium is then supplied by a source of fresh (for example, regenerated) fixing solution. A source of fresh fixing solution is shown at 301 in FIG. 2 of the drawing.

The purpose of an upright tank 1*e* in the vessel 1' is to ensure that the inflowing liquid medium becomes quiescent on its way into the narrower portion of the tank and toward the orifices 23. If desired or necessary, the orifices 23 can be staggered and/or they can form two or more horizontal or substantially horizontal rows.

The purpose of sprays or jets which issue from the orifices 23 is to wash away droplets and/or streaks or rivulets of developing solution which adhere to the photosensitive layer 21*a* and would have entered the nip of the rollers 9, 10 in the vessel 1' in the absence of any means for dispersing or washing away such accumulations of developing solution. In order to ensure that the sprays of liquid medium which issue via orifices 23 invariably wash away the just discussed accumulations of developing solution, the pump 30 preferably delivers the liquid medium at a substantial pressure such as is necessary to ensure highly satisfactory treatment of successive sheets 21 in the fixing bath F. Removal of droplets and/or streaks of developing solution ensures that the fixing bath F can uniformly treat each and every portion of each sheet, strip or web of photosensitive material all the way from the point of entry below the level 22 to the point of expulsion from the bath F. Such predictable treatment in the fixing bath F prevents the development of spots and/or other undesirable phenomena on the photosensitive layers 21*a* of sheets which are expelled from the vessel 1'. The spots would be likely to develop as a result of secondary development of corresponding portions of the layers 21*a* by the droplets and/or streaks of developing solution which are transferred from the developing bath E into the fixing bath F.

The orifices 23 in the upper portion of the tank 1*e* in the vessel 1' can constitute circular or oval openings or elongated slots. The number of such orifices depends upon the length of the rollers which form part of the conveying means. The cross-sectional area of the outlet of the pipe 24 depends on the combined cross-sectional area of the orifices 23. As mentioned above, the cross-sectional area of the outlet of the pipe 24 should at least match or exceed the combined cross-sectional area of all orifices 23. As concerns the output of the pump 30, it must be selected in such a way that the pressure of liquid medium in the tank 1*e* of the vessel 1' suffices to ensure the aforediscussed predictable and reliable removal of droplets and/or other accumulations of developing solution on the exposed side of the photosensitive layer 21*a* of a sheet 21 which is in the process of entering the fixing bath F. In accordance with a presently preferred embodiment of the invention, the orifices 23 constitute circular openings having a diameter of 3–4 mm and being spaced apart from each other at distances of approximately 20 mm.

The flow restrictor 25 constitutes an optional but desirable feature of the vessel 1'. Such flow restrictor renders it possible to prevent the development of eddy currents or other turbulence in the interior of the tank 1*e* the upper portion of which is formed with the orifices 23.

FIG. 2 shows a portion of a modified vessel 1' wherein the strips or sheets 21 of photosensitive material are introduced into the nip of the rollers 9, 10 in such a way that the photosensitive layer 21*a* faces upwardly or outwardly, i.e., away from the sidewall 1*c*. The tank 1*e* of the vessel 1' of FIG. 1 is replaced by a different source of liquid medium. Such source comprises a conduit 101*e* which is disposed above the roller 10 and has at least one row of orifices 123 serving to direct jets or sprays of liquid medium toward the photosensitive layer 21*a* of the strip or sheet 21 which is in the process of entering and advances through the nip of the rollers 9 and 10. The conduit which connects the tank 301 containing a fresh fixing liquid with the conduit 101*e* contains a pump 201 which ensures that the liquid medium issues from the orifices 123 at a requisite pressure. The conduit 101*e* can be replaced by or used jointly with a second conduit 101*e'* which is disposed at a level below the roller 10, i.e., below that roller of the pair of rollers 9, 10 which is more distant from the sidewall 1*c* of the vessel 1'. The conduit 101*e* is preferably closely adjacent to the roller 10.

In all other respects, the vessel 1' of FIG. 2 is or can be identical with the vessel 1' of FIG. 1.

An important advantage of the improved apparatus is that it contributes significantly to the predictability of treatment of successive sheets, strips or webs of photosensitive material, even if such material is advanced at a relatively low speed which, as discussed above, can be in the range of 5–40 cm/min. The means for directing liquid medium against the photosensitive layers of successive sheets or strips can be disposed below or above the upper level of liquid in the vessel 1'. The placing of the orifices at a level below the upper level 22 of the fixing bath F is desirable and advantageous because this reduces the likelihood of splashing of liquid medium which is sprayed onto the photosensitive layers 21*a*, especially if the liquid medium is discharged at an elevated pressure. Moreover, this ensures that the sprays of liquid medium are collected in the fixing bath F which is thus regenerated, especially if the source of liquid medium includes the tank 301 or another suitable source of fresh fixing solution. The placing of orifices 23 or 123 below the upper level of the fixing bath is further desirable and advantageous because this ensures rapid and thorough intermixing of sprayed liquid medium with the bulk of the liquid forming the fixing bath F.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for wet treatment of photosensitive material, comprising a first vessel for a first body of liquid; a second vessel for a second body of liquid; means for conveying the photosensitive material in a predetermined direction along a predetermined path having a first portion in the first vessel and a second portion in the second vessel, comprising a plurality of parallel rollers in said second vessel, comprising a plurality of parallel rollers in said second vessel; a source of liquid medium whose composition matches or approximates that of the second body of liquid, including a tank provided in said second vessel and having an upper portion and an enlarged lower portion; and means for directing the liquid medium against the photosensitive material downstream of the first portion and not later than in the second portion of said path, including a plurality of orifices provided in said upper portion and arranged to spray the liquid medium against the photosensitive material, said source further comprising a pipe arranged to deliver liquid medium into said lower portion and extending in substantial parallelism with said rollers.

2. The apparatus of claim 1 for wet treatment of material one side of which is coated with a photosensitive substance, wherein said orifices are arranged to spray the liquid medium against the photosensitive substance at the one side of the photosensitive material.

3. The apparatus of claim 1, wherein said source comprises means for pumping the liquid medium into said upper portion.

4. The apparatus of claim 1 for wet treatment of material one side of which is coated with a photosensitive substance, wherein said conveying means comprises means for advancing the material past said directing means in such a way that the photosensitive substance is disposed at the underside of the material.

5. The apparatus of claim 1, wherein the combined area of said orifices at most equals the cross-sectional area of said pipe.

6. The apparatus of claim 1, wherein said orifices form at least one row extending transversely of said direction and are arranged to discharge neighboring streams of liquid medium in such a way that the neighboring streams contact or partially overlap each other.

7. The apparatus of claim 1 wherein said pipe has an outlet disposed at a predetermined level and said tank comprises a flow restrictor between said level and said upper portion.

8. The apparatus of claim 1, wherein said source includes means for feeding the liquid of said second body to said directing means.

9. The apparatus of claim 8, wherein said feeding means includes pump means for inducing the flow of liquid from the body in said second vessel into said tank.

10. The apparatus of claim 1, wherein said vessels are substantially identical and said conveying means comprises substantially identical first and second units for respectively advancing the photosensitive material through said first and second vessels.

11. Apparatus for wet treatment of photosensitive material, comprising a first vessel for a developing bath; a second vessel for a fixing bath which fills the second vessel to a predetermined level; means for conveying the photosensitive material in a predetermined direction along a predetermined path having a first portion in the first vessel and a second portion in the second vessel, said conveying means including rollers at least one of which is disposed in said second vessel at least in part below said predetermined level; a source of liquid medium whose composition matches or approximates that of the fixing bath, said source including a tank provided in said second vessel and having a closed top; and means for directing the liquid medium against the photosensitive material below said predetermined level and above said at least one roller in the second portion of said path, said directing means comprising a plurality of orifices provided in said tank and arranged to direct sprays of liquid medium against the photo-sensitive material in the region of said one roller.

12. The apparatus of claim 11, further comprising means for maintaining said predetermined level of fixing bath in the second vessel.

* * * * *